United States Patent [19]

Lutz

[11] 4,237,715

[45] Dec. 9, 1980

[54] ROLLING MILL PASS-LINE ADJUSTING MECHANISM

[75] Inventor: LaVerne H. Lutz, Salem, Ohio

[73] Assignee: Gulf & Western Manufacturing Company, Southfield, Mich.

[21] Appl. No.: 27,491

[22] Filed: Apr. 5, 1979

[51] Int. Cl.[3] ..... B21B 31/30

[52] U.S. Cl. ..... 72/244

[58] Field of Search ..... 72/244, 245, 237

[56] References Cited

U.S. PATENT DOCUMENTS

| | | | |
|---|---|---|---|
| 679,413 | 7/1901 | Bunker | 72/244 |
| 2,969,042 | 1/1961 | Litz et al. | 72/244 |
| 3,779,062 | 12/1973 | Gegick | 72/244 |
| 3,805,573 | 4/1974 | Petros et al. | 72/244 |
| 4,038,857 | 8/1977 | Eibe et al. | 72/244 |

FOREIGN PATENT DOCUMENTS

| | | | |
|---|---|---|---|
| 2442891 | 3/1976 | Fed. Rep. of Germany | 72/244 |
| 2513666 | 10/1976 | Fed. Rep. of Germany | 72/244 |

*Primary Examiner*—Milton S. Mehr

*Attorney, Agent, or Firm*—Meyer, Tilberry & Body

[57] ABSTRACT

A pass-line adjusting mechanism is disclosed in association with the chocks of the lower back-up roll of a four-high rolling mill. The adjusting mechanism includes an axially slidable adjusting member having vertically stepped surface portions corresponding to each lower back-up roll chock, and an inverted channel-shaped support member interposed between the chocks and adjusting member. The support member has hardened upper surfaces underlying the chocks and engaging rocker plates thereon, and cross members providing lower surfaces engaging corresponding ones of the steps on the adjusting member. The support member is adapted to be elevated to lift the lower surfaces thereof from the adjusting member, and the adjusting member is adapted to be displaced relative to the support member when the latter is elevated to selectively position any corresponding pair of the steps thereof beneath the lower surfaces of the support member.

29 Claims, 5 Drawing Figures

ROLLING MILL PASS-LINE ADJUSTING MECHANISM

BACKGROUND OF THE INVENTION

This invention relates to the art of rolling mills and, more particularly, to a mechanism for vertically adjusting the lower roll of a multiple roll mill.

It is of course well known that the pass-line of a rolling mill is the path of movement of sheet metal through the mill between the working rolls thereof. It is likewise well known that the elevation of the pass-line with respect to the mill floor line must be maintained within reasonable limits regardless of the work and back-up roll diameters. In this respect, various devices such as strip guides, coolant sprays, bridle rolls, pass-line guide rolls, and the like are provided at fixed elevations with respect to the floor line on the entry and/or exit side of the mill. Accordingly, a number of procedures and mechanisms have been provided heretofore to enable vertical adjustment of the pass-line to maintain the latter within the limits established by such fixed equipment, or to maintain the lower roll of a multiple roll mill at an elevation within desired limits.

Many arrangements have been provided heretofore for achieving pass-line adjustment, including mechanisms operable between the lower back-up roll chocks and the mill housing to change the vertical positions of the chocks relative to the housing and thus the vertical position of the pass-line. Such mechanisms have included adjusting members interposed between the lower backup roll chocks and the mill housing and having upper surface portions associated with each of the chocks and varying in vertical height along the lengths of the surface portions. Thus, by changing the axial position of the adjusting member, the vertical positions of the chocks and thus the pass-line can be elevated or lowered. In certain arrangements heretofore provided, the upper surfaces of the adjusting member or members are vertically stepped to provide distinct increments of vertical adjustment of the chocks. The stepped surfaces of such adjusting members are directly engaged by the lower back-up roll chock assemblies and, accordingly, must be hardened or otherwise made wear resistant, which is procedurally expensive and time consuming from the standpoint of manufacture thereof. Moreover, in order to provide for small increments of vertical adjustment of the pass-line, the adjusting members are of a considerable length and, depending on the position of the adjustment member, they are exposed within the mill housing and/or adjacent the entry or exit side thereof. Accordingly, and especially during operation of the mill, lubricant, dirt, metal chips and the like can fall onto the exposed surfaces of the adjusting members causing undesirable wear and/or damage thereto and to surfaces of the chock assemblies engaging therewith. This problem results in increasing maintenance and down time for the mill in an effort to minimize such wear and damage. Still further, in connection with adjusting members having vertically stepped surface portions, arrangements heretofore employed to elevate and lower the backup roll chock assemblies to enable displacement of the adjusting member have been structurally complex and have been incorporated in the mill housing in association with the chocks, thus increasing production costs with respect to the mill and maintenance time and costs with respect to repair and/or displacement of the chock elevating mechanisms.

SUMMARY OF THE INVENTION

The present invention relates to a pass-line adjusting mechanism of the character including an axially displaceable adjusting member or members between a mill housing and lower back-up roll chock assemblies. In accordance with the present invention, the foregoing disadvantages, and others, of such mechanisms heretofore provided are advantageously avoided or minimized by a vertically displaceable support arrangement between the roll chocks and adjusting member or members. More particularly, in accordance with the preferred embodiment, a vertically displaceable support member is interposed between the lower back-up roll chocks and an adjusting member extending therebetween, and the support member is provided with lower surfaces for interengaging with corresponding variable height surface portions of the adjusting member. The roll chocks directly engage the support member rather than the adjusting member and, accordingly, the varying height surface portions of the adjusting member do not have to be hardened, whereby the time and cost of production thereof is minimized. Still further, the support member is employed to elevate the lower back-up roll chocks to facilitate axial displacement of the adjusting member and advantageously provides a structurally simple arrangement for this purpose. In accordance with another aspect of the invention, the support member additionally provides a protective shield which effectively protects the upper surface portions of the adjusting member and the underlying support surfaces therefor against the fall of lubricant, metal particles, dirt and the like thereonto.

Accordingly, it is an outstanding object of the present invention to provide an improved roll mill pass-line adjusting mechanism of the character including an axially displaceable adjusting member or members having surface portions of varying height positionable beneath the lower back-up roll chocks to vertically position the chocks and thus the pass-line in accordance with the axial positions of the surface portions of the support member or members.

Another object is the provision of a pass-line adjusting mechanism of the foregoing character which avoids the necessity of hardening the variable height surface portions of the adjusting member or members.

A further object is the provision of a pass-line adjusting mechanism of the foregoing character which includes a structurally simple and economic arrangement for elevating the lower back-up roll chocks to facilitate axial displacement of the adjusting member or members to achieve pass-line adjustment.

Yet another object is the provision of a pass-line adjusting mechanism of the foregoing character in which component parts of the elevating mechanism also protect the adjusting member or members from exposure to lubricant, metal chips, dirt and the like, thus to minimize wear of and/or damage to the varying height surface portions and underlying support surfaces for the adjusting member or members and maintenance and replacement time and expense with respect thereto.

Yet a further object is the provision of a pass-line adjusting mechanism of the foregoing character which includes a vertically displaceable support member extending between the roll chocks and directly interposed between each chock and the corresponding variable height surface portion of the adjusting member and which support member facilitates elevating the roll chocks to enable axial displacement of the adjusting member and shields the adjusting member from exposure to lubricant, metal chips, dirt and the like.

Still another object is the provision of a pass-line adjusting mechanism of the foregoing character which is efficient in operation and more economical to produce and operate than heretofore possible.

BRIEF DESCRIPTION OF THE DRAWINGS

The foregoing objects, and others, will in part be obvious and in part pointed out more fully hereinafter in connection with the description of a preferred embodiment of the invention illustrated in the accompanying drawings in which.

DESCRIPTION OF A PREFERRED EMBODIMENT

Figure 1:
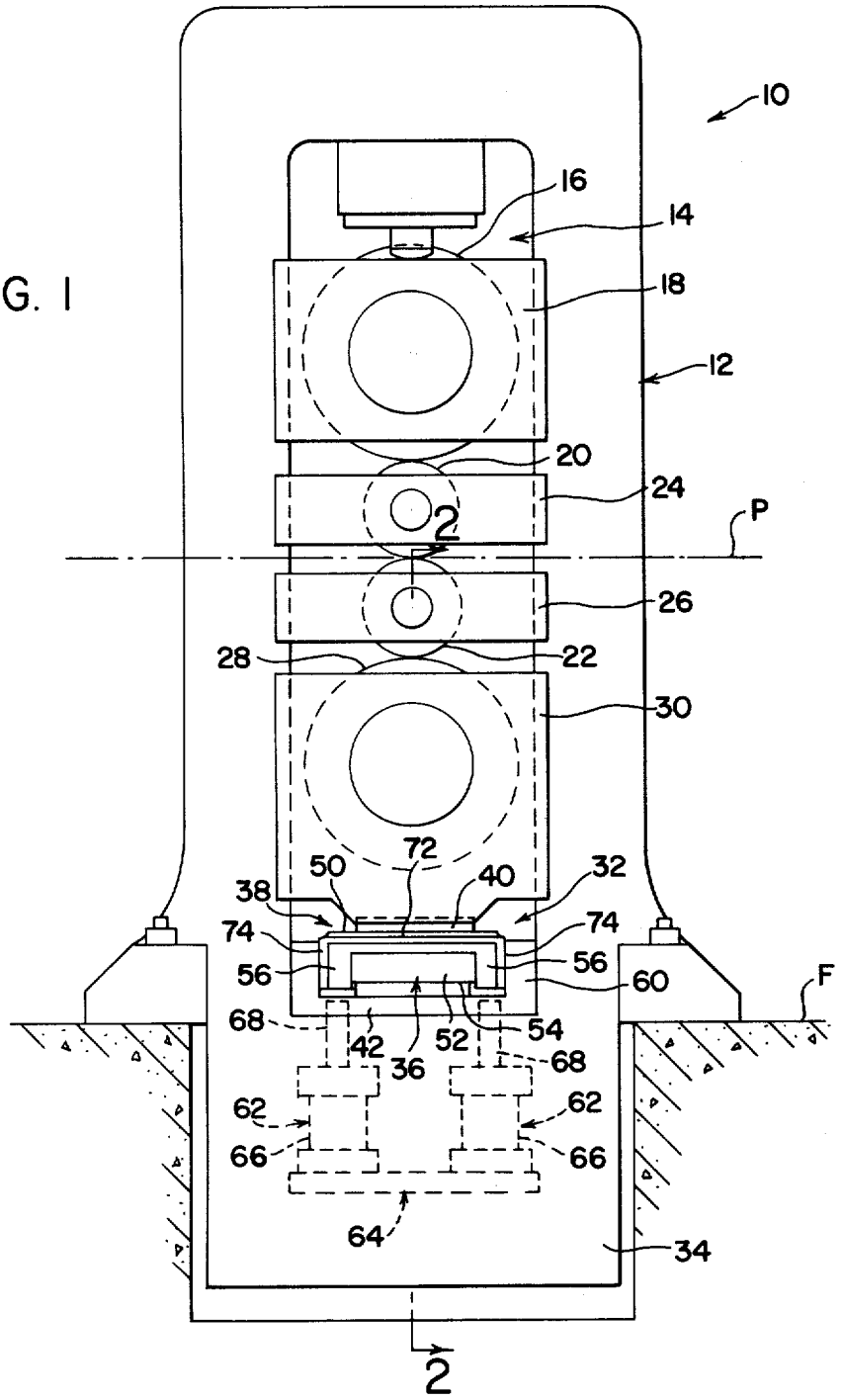
FIG. 1 is an end elevation view of a four-high rolling mill including a pass-line adjusting mechanism in accordance with the present invention.
Figure 2:
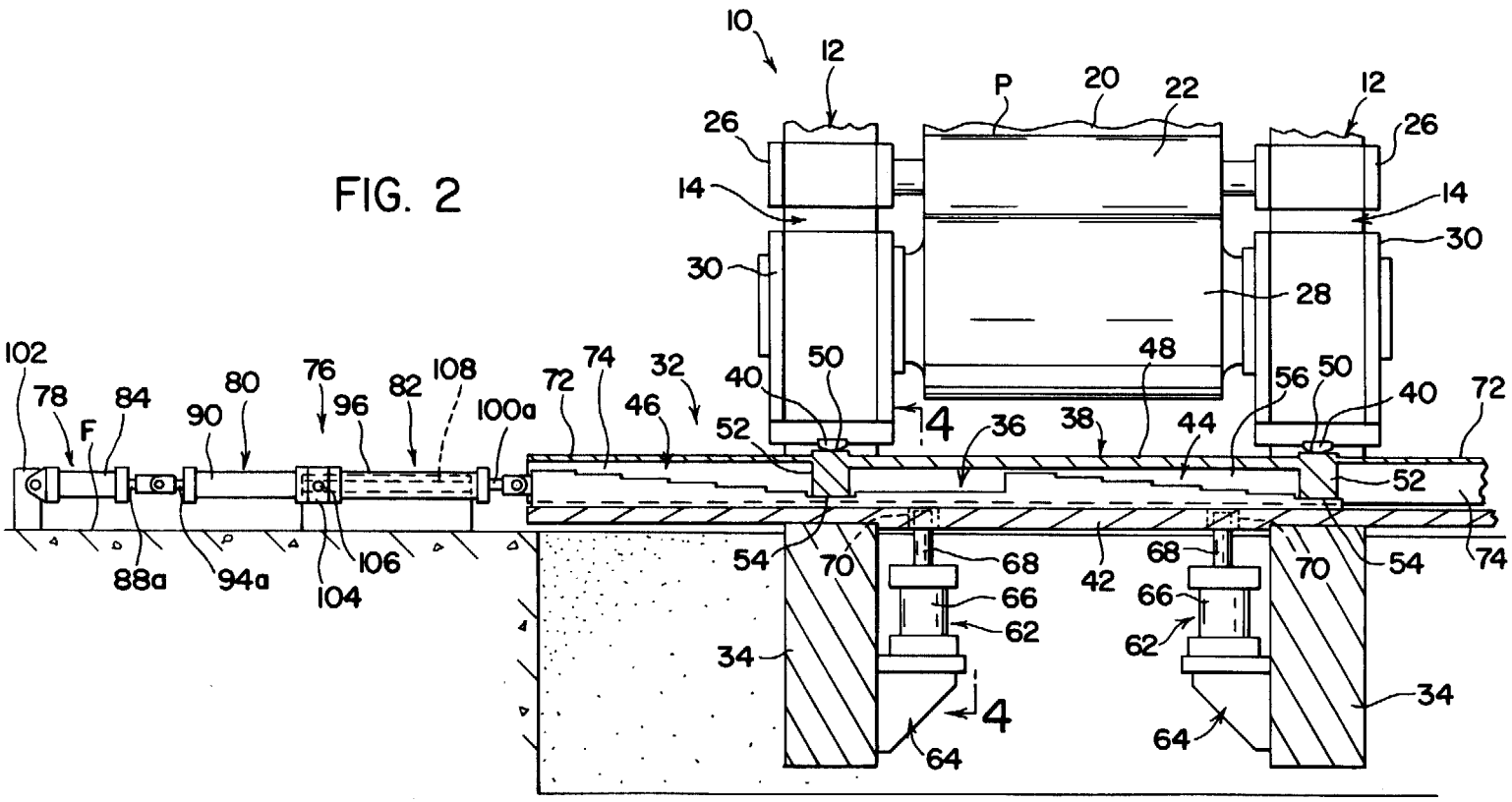
FIG. 2 is a sectional elevation view of the adjusting mechanism taken along line 2—2 in FIG. 1.

Referring now in greater detail to the drawings wherein the showings are for the purpose of illustrating a preferred embodiment of the invention only and not for the purpose of limiting the invention, a four-high rolling mill stand 10 is shown in FIGS. 1 and 2 which, as is well known, is comprised of a pair of axially spaced apart housing members each providing a window 14 in which the corresponding ends of the mill rolls are supported for rotation and for vertical displacement relative to the housing. More particularly in this respect, as will be appreciated from FIG. 1, the upper back-up roll 16 has its opposite ends rotatably supported by chocks 18 slidably received in the window of the corresponding housing member 12, upper and lower work rolls 20 and 22, respectively, have their opposite ends rotatably supported by corresponding bearing chock assemblies 24 and 26 slidably received in the window of the corresponding housing member, and lower back-up roll 28 has its opposite ends rotatably supported by chocks 30 slidably received in the window of the corresponding housing member 12. Sheet material to be worked in the mill passes between work rolls 20 and 22 along a path P which defines the pass-line for the mill stand. In accordance with the present invention, a pass-line adjusting mechanism 32 is interposed between lower back-up roll chocks 30 and the closed bottom portion 34 of housing members 12 to facilitate adjusting the vertical position of pass-line P relative to the floor line F for the mill stand.

The structure of adjusting mechanism 32 and the structural association thereof with the lower back-up roll chocks and mill housing members is illustrated in detail in FIGS. 2–5 of the drawing. With reference to the latter Figures, adjusting mechanism 32 includes an axially reciprocable adjusting member 36 slidably supported on the housing members 12 as more fully set forth hereinafter, and a vertically displaceable support member 38 interposed between adjusting member 36 and the lower ends of lower back-up roll chocks 30. In the embodiment disclosed, the lower ends of chocks 30 are defined by laterally extending rocker plates 40 received in corresponding recesses in chocks 30. Adjusting member 36 has a lateral width generally corresponding to the length of rocker plates 40 and is supported for axial reciprocation by means of an underlying slide plate 42 extending between housing members 12. In the embodiment shown, slide plate 42 rests on the bottom edges of the windows of housing members 12 as defined by bottom portions 34 of the housing members and, preferably, extends axially outwardly of the corresponding housing member a distance sufficient to support adjusting member 36 when the latter is in either of its extreme axially opposite positions relative to housing members 12.

Adjusting member 36 includes axially extending upper surface portions 44 and 46 each of which varies in vertical height along the length thereof, and each of which is functionally associated with support member 38 and with one of the lower back-up roll chocks 30 as will become apparent hereinafter. In the embodiment shown, upper surface portions 44 and 46 increase in vertical height in the same axial direction, and the height variation of each surface portion is defined by a corresponding plurality of axially adjacent vertically spaced horizontal planar surfaces extending laterally across the adjusting member. While seven such planar surfaces are shown for each of the surface portions 44 and 46, it will be appreciated that the surface portions may include a greater or lesser number of such surfaces. As set forth more fully hereinafter, the planar surfaces of each surface portion are adapted to be selectively positioned beneath the lower back-up roll chock with which the corresponding surface portion 44 or 46 is associated. It will be appreciated, of course, that the planar surfaces of the two surface portions 44 and 46 provide pairs of surfaces having the same vertical elevation with respect to the housing members, whereby the lower back-up roll chocks 30 have the same elevation when adjusting member 36 is in a given axial position relative to housing members 12.

Support member 38 includes a top plate portion 48 extending between lower back-up roll chocks 30 and having laterally extending upper surface portions 50 underlying rocker plates 40. Further, the underside of top plate portion 48 is provided with laterally extending cross members 52 providing laterally extending lower surfaces 54 underlying the corresponding upper surface 50 and adapted to rest on a planar surface of the corresponding one of the upper surface portions 44 and 46 of adjusting member 36. Each cross member 52 has a vertical height sufficient to provide clearance between the underside of top plate portion 48 and the highest elevation of upper surface portions 44 and 46 of adjusting member 36.

Support member 38 further includes axially extending laterally opposite side portions 56 extending downwardly from top plate portion 48 along and laterally outwardly of the sides of adjusting member 36. Side portions 56 terminate slightly above the top surface of slide plate 42 when cross members 52 rest on the lowermost planar surfaces of the adjusting member. Preferably, guide blocks 60 extend axially between windows 14 of mill housing members 12 and engage the outer surfaces of side portions 56 to slidably support and guide support member 38 for vertical displacement relative to housing members 12. In the embodiment shown, top plate portion 48, cross members 52 and side portions 56 of support member 38 are of one piece construction, and guide blocks 60 are formed integrally with slide plate 42. However, it will be appreciated that support member 38 could be an assembly of component parts welded or otherwise interconnected with one another, and that slide plate 42 and guide blocks 60 could be individual components mounted on the mill housing members.

As mentioned hereinabove, support member 38 is adapted to be elevated and lowered relative to adjusting member 36 and mill housing members 12 so as to elevate and lower back-up roll chocks 30 during a mill pass-line adjusting operation. In the embodiment disclosed, such elevating and lowering of support member 38 is achieved by four hydraulic piston-cylinder units 62 disposed beneath slide plate 42 in vertical alignment with side portions 56 of support member 38. More particularly, piston-cylinder units 62 are mounted in pairs on lower portions 34 of mill housing members 12 by means of corresponding bracket assemblies 64, and each unit includes a cylinder 66 suitably attached to the corresponding bracket assembly and a pistonrod 68 attached to a piston in the cylinder for vertical reciprocation therewith. Openings 70 are provided in slide plate 42 for the piston rods which, in their retracted positions as shown in FIG. 4, are spaced below the bottom surfaces of side portions 56 of support member 38. Upon actuation of piston-cylinder units 62 to extend piston rods 68, the latter engage beneath side portions 56 of support member 38 and elevate the latter and thus lower back-up roll chocks 30 to the broken line positions thereof shown in FIGS. 3. It will be appreciated that piston rods 68 have a stroke sufficient to provide for support member 38 to be elevated so that the bottom surfaces 54 of cross members 52 vertically clear the highest planar surfaces of surface portions 44 and 46 of adjusting member 36. When so elevated, adjusting member 36 is axially displaced, as set forth more fully hereinafter, to position selected planar surfaces of surface portions 44 and 46 vertically beneath cross members 52 and, thereafter, piston-cylinder units 62 are actuated to retract piston rods 68 and thus lower support member 38 for bottom surfaces 54 thereof to engage the selected planar surfaces. It will be appreciated, of course, that suitable fluid flow lines and controls, not illustrated, are provided for piston-cylinder units 62 to achieve elevating and lowering of support member 38 in the foregoing manner.

Figure 3:
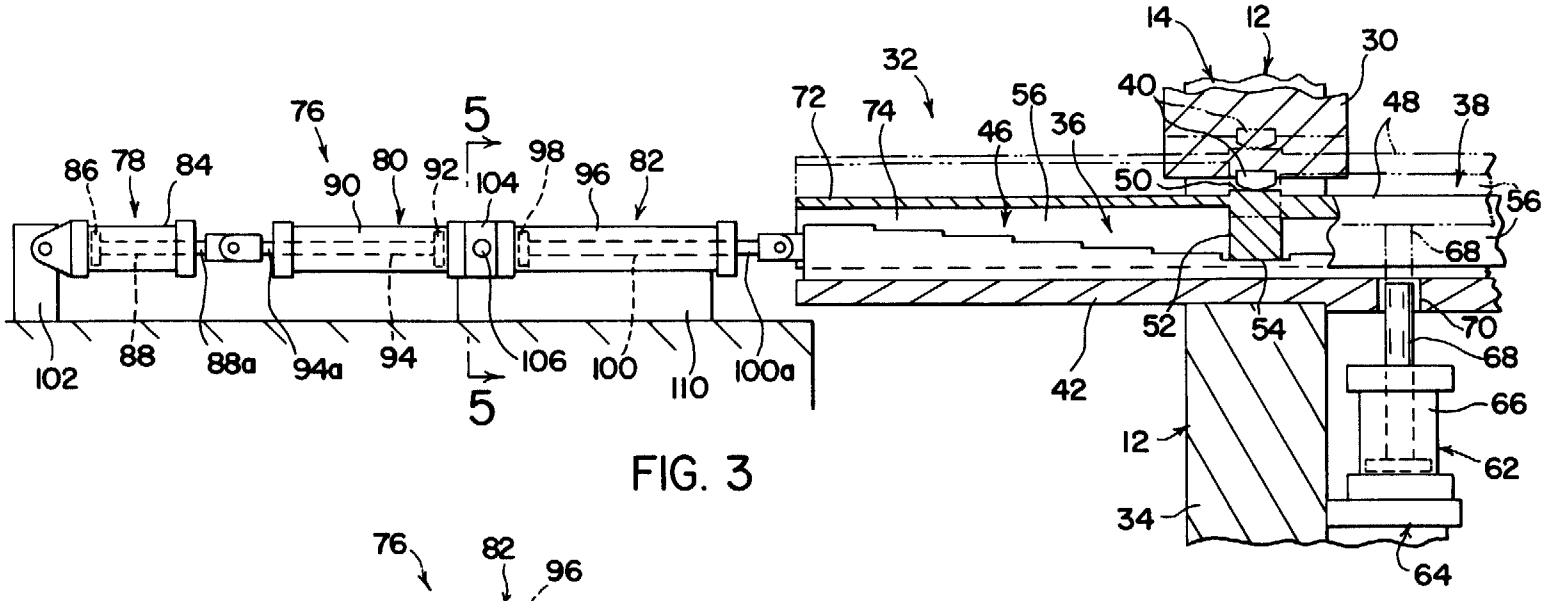
FIG. 3 is a detail side elevation view, partially in section, showing the operating mechanisms for the adjusting member and support member components of the adjusting mechanism.
Figure 4:
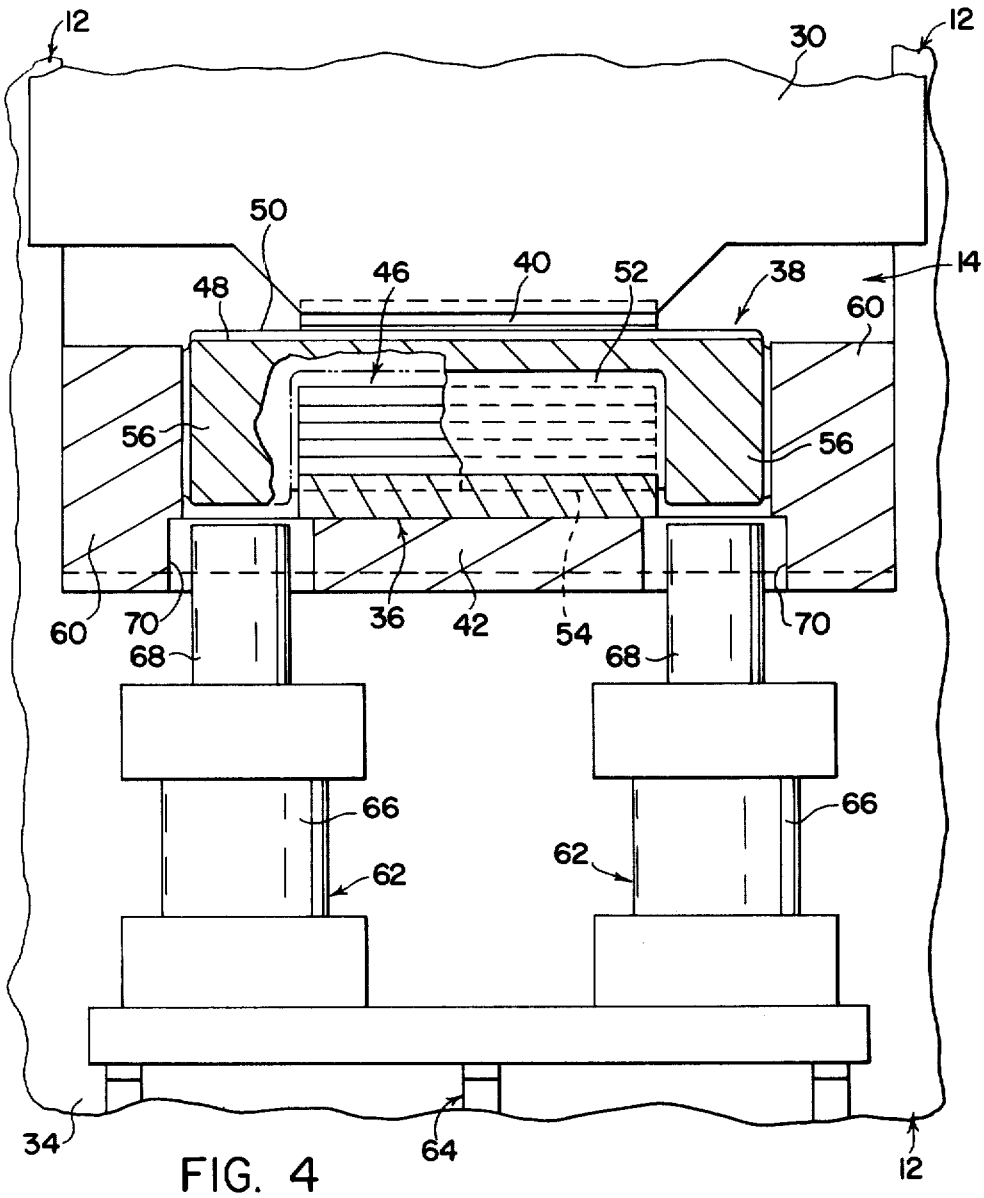
FIG. 4 is a sectional elevation view of the adjusting mechanism taken along line 4—4 in FIG. 2; and, FIG. 5 is a sectional elevation view of the operating mechanism for the adjusting member taken along line 5—5 in FIG. 3.

Preferably, as seen in FIGS. 1-3, support member 38 is provided with top plate extensions 72 extending axially outwardly from each of the cross members 52, and side plate extensions 74 depending from the laterally opposite sides of top plates 72. Plates 72 and 74 extend axially outwardly of the corresponding mill housing member 12 a distance sufficient to cover the adjusting member 36 when the latter is in either of its extreme axially opposite positions relative to the mill housing. Thus, plate extensions 72 and 74 together with top plate portion 48 and side portions 56 of support member 38 protect adjusting member 36 from exposure to dirt, lubricant, metal chips and the like which can fall onto the adjusting member, or slide plate 42 therebeneath, and which would promote wear and/or damage surface portions 44 and 46 of the adjusting member as well as the slidingly interengaged surfaces of the adjusting member and slide plate 42.

Figure 5:
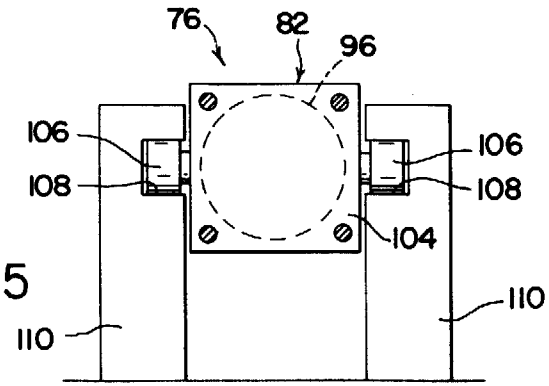

As mentioned hereinabove, piston-cylinder units 62 are adapted to be actuated to elevate support member 38 and thus lower back-up roll chocks 30 to the broken line positions thereof illustrated in FIG. 3 of the drawing. Thereafter, adjusting member 36 is adapted to be displaced axially to position desired ones of the planar surfaces of upper surface portions 44 and 46 of the adjusting member beneath the corresponding one of the cross members 52 of support member 38. In the embodiment disclosed, such axial displacement of adjusting member 36 is achieved by means of a three-stage digital cylinder assembly 76 which is supported adjacent the mill stand and connected to one of the opposite ends of adjusting member 36. As seen in FIGS. 2, 3 and 5 of the drawing, digital cylinder assembly 76 is comprised of first, second and third piston-cylinder units 78, 80 and 82, respectively. Piston-cylinder unit 78 includes a cylinder 84, a piston 86 reciprocable therein, and a piston rod 88 attached to the piston and having an outer end **88*a*. Similarly, piston-cylinder unit 80 includes a cylinder 90, a piston 92 reciprocable therein and a piston rod 94 attached to the piston and having an outer end 94*a*, and piston-cylinder unit 82 includes a cylinder 96, a piston 98 reciprocable therein, and a piston rod 100 connected to the piston and having an outer end 100*a*. Cylinder 84 of piston-cylinder unit 78 is pivotally attached to a support post or the like 102, and outer end 88*a* of piston rod 88 is suitably coupled with outer end 94*a* of piston rod 94 of piston-cylinder unit 80. Further, cylinders 90 and 96 of piston-cylinder units 80 and 82 are each suitably fastened to a support block 104 provided on its laterally opposite sides with rollers 106 received in corresponding roller track recesses 108 of a pair of guide and support blocks 110, whereby piston-cylinder units 80 and 82 are reciprocably supported by blocks 110. To complete the assembly, outer end 100*a* of piston rod 100 is pivotally attached to adjusting member 36**. It will be appreciated of course that suitable fluid flow lines and controls, not shown, are provided to actuate the piston-cylinder units in the manner set forth hereinafter.

In the embodiment disclosed, each of the upper surface portions 44 and 46 of adjusting member 36 is comprised of seven axially adjacent vertically spaced planar surfaces providing seven pairs of vertical steps, each of which pair is associated with one of the lower back-up chocks 30 and the corresponding cross member 52 of support member 38. As seen in FIGS. 2-4, cross members 52 of support member 38 are in engagement with the lowermost pair of such planar surfaces. If each of the planar surfaces of the two upper surface portions 44 and 46 has an axial width of twelve inches, and the strokes of pistons 86, 92 and 98 of piston-cylinder units 78, 80 and 82 are twelve, twenty-four and thirty-six inches, respectively, it will be appreciated that the tandem arrangement of the piston-cylinder units enables selective displacement of adjusting member 36 to position any given pair of the planar surfaces thereon beneath cross members 52 of support member 38. In this respect, the position of adjusting member 36 shown in FIGS. 2 and 3 is the zero displacement position with respect to pistons 86, 92 and 98. By actuating piston-cylinder unit 78 alone, the stroke of piston 86 displaces piston-cylinder units 80 and 82 and thus adjusting member 36 twelve inches to the right in FIGS. 2 and 3, thus to position the second step of each upper surface portion 44 and 46 beneath the corresponding cross member 52 of support member 38. Similarly, by actuating piston-cylinder unit 80 alone, cylinder 90 and piston-cylinder unit 82 are displaced relative to piston 92 and to the right in FIGS. 2 and 3,whereby the twenty-four inch stroke of piston 92 relative to cylinder 90 positions the third steps beneath cross members 52. As another example, by simultaneously actuating piston-cylinder units 78 and 82, the stroke of piston 86 displaces units 80 and 82 and thus adjusting member 36 twelve inches to the right in FIGS. 2 and 3, and the displacement of piston 98 displaces adjusting member 36 an additional thirty-six inches to the right for a total displacement of forty-eight inches, which positions the fifth pair of steps beneath the cross members 52. Accordingly, it will be appreciated that the piston-cylinder units are actuable alone and in various combinations to enable selective displacement of adjusting member 36 to position any desired ones of the seven pairs of the steps beneath cross members 52 of support members 38.

From the foregoing description, it will be appreciated that a pass-line adjustment is adapted to be readily made, and that the adjusting mechanism is structurally simple, economical to produce and minimizes maintenance costs and down time while providing the necessary structural integrity and stability both for the pass-line adjusting operation and for support of the lower back-up roll chocks and thus the mill rolls during mill operation. In particular in this respect, only upper surface portions 50 of support member 38 have to be hardened, and planar surfaces 54 of cross members 52 and the planar surfaces of surface portions 44 and 46 adjusting member 36 facially interengage to provide the desired stability with respect to their chock and roll supporting functions. The planar relationship of the latter surfaces and the positioning thereof vertically beneath the chocks minimizes wear thereof and avoids the necessity of hardening their surfaces. Morover, structural stability is enhanced by the sliding and guiding relationship between sides 56 of support member 38 and guide blocks 60 on slide plate 42.

While considerable emphasis has been placed herein on the structure of the component parts of the preferred embodiment and the structural interrelationships between the component parts thereof, it will be appreciated that many modifications of the preferred embodiment are possible without departing from the principles of the present invention. For example, drive arrangements other than piston-cylinder units can be employed to achieve the elevating and lowering of support member 38 and thus the lower back-up roll chocks. In this respect, for example, screw jacks could be employed for this purpose. Further, it will be appreciated that portions of the support member other than side portions 56 can be engaged by components of the elevating and lowering drive arrangement, and that the support member can be constructed and associated with the mill housing members for the drive mechanism or mechanisms to be located other than as shown in connection with the preferred embodiment. Still further, while it is preferred to provide a single adjusting member having surface portions varying in height in the same direction along the length of the adjusting member so as to enable actuation thereof from one end, it will be appreciated that a pair of actuating members could be employed at axially opposite ends of the mill housing, each associated with a corresponding one of the lower back-up roll chocks and provided with a corresponding displacing mechanism. In such an arrangement, the surface portions would vary in height in opposite directions with respect to one another, and the adjusting members would be displaced toward or away from one another during a given pass-line adjusting operation. Moreover, in connection with modifications of the preferred arrangement herein disclosed, it will be appreciated that the varying height surface portions can be provided other than by horizontal planar surfaces, and that the mechanism or mechanisms for positioning the surfaces can be binary or digital motor arrangements other than that described herein as well as drive arrangements other than digital drive arrangements. For example, a single piston-cylinder unit could be employed with a total stroke corresponding to the axial length of the varying height surface portions of the adjusting member, with limit switches or the like controlling fluid flow to the piston-cylinder unit so as to position the adjusting member or members in a selected one of the several positions thereof. Still further, while the invention has been disclosed and described in connection with a four-high mill, it will be readily appreciated that the invention is applicable to other multiple roll mills such as two, three and six-high mills, for example, and for adjusting the lower roll either to maintain or adjust the mill pass-line or to achieve or maintain a desired elevation of the lower roll.

Since many embodiments of the present invention can be made, and since many changes can be made in the preferred embodiment herein illustrated and described, it is to be distinctly understood that the foregoing descriptive matter is to be interpreted merely as illustrative of the present invention and not as a limitation.

Having thus described the invention, it is claimed:

1. An adjusting mechanism for a multiple roll strip mill including housing means, a lower roll, and a pair of axially spaced apart chocks supporting said lower roll for vertical movement relative to said housing means, said adjusting mechanism including axially reciprocable adjusting member means supported on said housing means beneath said pair of chocks, vertically displaceable support member means between said pair of chocks and said adjusting member means, said adjusting member means having surface means varying in vertical height axially thereof and interengageable with said support member means to adjust the vertical positions of said chocks in accordance with the axial position of said adjusting member means, means to elevate and lower said support member means and said pair of chocks relative to said adjusting member means, and means to axially displace said adjusting member means when said support member means is elevated.

2. An adjusting mechanism according to claim 1, wherein said surface means of said adjusting member means includes axially adjacent vertically spaced planar surfaces.

3. An adjusting mechanism according to claim 1, wherein said means to displace said adjusting member means includes digital drive motor means.

4. An adjusting mechanism according to claim 3, wherein said surface means of said adjusting member means includes a plurality of axially adjacent vertically spaced planar surfaces, said motor means being selectively operable to position any given one of said surfaces beneath the corresponding one of said pair of chocks.

5. An adjusting mechanism according to claim 4, wherein said motor means includes a plurality of fluid operated piston and cylinder units connected in tandem.

6. An adjusting mechanism according to claim 1, wherein said support member means includes a top portion extending axially between said pair of chocks, and axially extending side portions depending from said top portion.

7. An adjusting mechanism according to claim 6, wherein said means to elevate and lower said support member means includes vertically reciprocable means beneath said side portions.

8. An adjusting mechanism according to claim 6, wherein said adjusting member means extends beneath said top portion of said support member means and between said side portions of said support member means.

9. An adjusting mechanism according to claim 8, wherein said support member means includes laterally extending cross members underlying said top portion in vertical alignment with said pair of chocks, each of said cross member having a lower surface engaging said surface means of said adjusting member means.

10. An adjusting mechanism according to claim 9, wherein said surface means of said adjusting member means includes axially adjacent vertically spaced planar surfaces.

11. An adjusting mechanism according to claim 9, wherein said adjusting member means includes an adjusting member extending between said pair of chocks, and said surface means includes first and second surface portions each corresponding to one of said pair of chocks.

12. An adjusting mechanism according to claim 11, wherein said means to elevate and lower said support member means includes vertically reciprocable means beneath said side portions.

13. An adjusting mechanism according to claim 11, wherein each said first and second surface portions include a plurality of axially adjacent vertically spaced planar surfaces.

14. An adjusting mechanism according to claim 13, wherein said means to displace said adjusting member means includes digital drive motor means connected to said adjusting member at one end thereof.

15. An adjusting mechanism according to claim 14, wherein said means to elevate and lower said support member means includes vertically reciprocable piston rod means beneath said side portions.

16. A strip pass-line adjusting mechanism for a four-high strip mill including housing means, upper and lower back-up rolls, upper and lower work rolls between said back-up rolls, and means supporting said back-up and work rolls for vertical movement relative to said housing means including first and second axially spaced apart chocks for said lower back-up roll, said adjusting mechanism including an axially reciprocable adjusting member extending between and underlying said chocks, means slidably supporting said adjusting member on said housing means, said adjusting member having axially extending first and second upper surface portions corresponding respectively to said first and second chocks, each said surface portion varying in vertical height along the length thereof and in the same direction axially with respect to one another, a support plate member extending between said chocks and interposed between said chocks and said adjusting member, said support plate member having first and second lower surface portions corresponding respectively to said first and second upper surface portions of said adjusting member and engaging said upper surface portions to support said chocks in vertical positions relative to said housing means in accordance with the axial position of said adjusting member, means to elevate and lower said support plate member and said first and second chocks relative to said adjusting member, and means to axially displace said adjusting member relative to said support plate member when said plate member is elevated.

17. An adjusting mechanism according to claim 16, wherein said means slidably supporting said adjusting member includes a slide plate on said housing means underlying said adjusting member, said support plate member including a top portion and side portions depending therefrom toward said slide plate.

18. An adjusting mechanism according to claim 17, wherein each said first and second lower surface portions of said support plate member is provided by a cross member beneath said top portion and extending laterally between said side portions.

19. An adjusting mechanism according to claim 18, wherein said means to elevate and lower said support plate member includes vertically reciprocable rod means beneath each said portion of said support plate member, and fluid operated piston and cylinder means for said rod means.

20. An adjusting mechanism according to claim 19, wherein said adjusting member has axially opposite ends and said means to axially displace said adjusting member is connected to one of said opposite ends and includes a plurality of fluid operated piston and cylinder units connected in tandem.

21. An adjusting mechanism according to claim 16, wherein said first and second surface portions of said adjusting member include corresponding pluralities of axially adjacent vertically spaced planar surfaces.

22. An adjusting mechanism according to claim 21, wherein said means to displace said adjusting member is drive means selectively operable to position any corresponding ones of said planar surfaces of said first and second surface portions beneath said first and second lower surface portions of said support plate member.

23. An adjusting mechanism according to claim 22, wherein said drive means is a plurality of fluid actuated piston and cylinder units connected in tandem.

24. An adjusting mechanism according to claim 21, wherein each said first and second lower surface portions of said support plate member is planar and provided by a cross member on said support plate member extending laterally thereof.

25. An adjusting mechanism according to claim 24, wherein said adjusting member has laterally opposite sides, and said support plate member includes a top portion and side portions depending therefrom along the length thereof, said side portions extending vertically along said opposite sides of said adjusting member in laterally outwardly spaced relationship with respect thereto.

26. An adjusting mechanism according to claim 25, wherein said means to elevate and lower said support plate member includes vertically reciprocable rod means beneath each side portion of said support plate member, and fluid operated piston and cylinder means for said rod means.

27. An adjusting mechanism according to claim 25, wherein said means to displace said adjusting member is drive means selectively operable to position any corresponding ones of said planar surfaces of said first and second surface portions beneath said first and second lower surface portions of said support plate.

28. An adjusting mechanism according to claim 27, wherein said drive means is a plurality of fluid actuated piston and cylinder units connected in tandem.

29. An adjusting mechanism according to claim 28, wherein said means to elevate and lower said support plate member includes vertically reciprocable rod means beneath each side portion of said support plate member, and fluid operated piston and cylinder means for said rod means.

* * * * *